US005336856A

United States Patent [19]

Krider et al.

[11] Patent Number: 5,336,856

[45] Date of Patent: Aug. 9, 1994

[54] ELECTRONIC MUFFLER ASSEMBLY WITH EXHAUST BYPASS

[75] Inventors: James K. Krider, North Vernon; Wilbur H. Crawley, III; David E. Wright, both of Columbus, all of Ind.

[73] Assignee: Arvin Industries, Inc., Columbus, Ind.

[21] Appl. No.: 157,470

[22] Filed: Nov. 26, 1993

Related U.S. Application Data

[63] Continuation of Ser. No. 909,965, Jul. 7, 1992, abandoned.

[51] Int. Cl.[5] ..... F01N 1/06

[52] U.S. Cl. ..... 181/206

[58] Field of Search ..... 181/206, 207, 249, 255, 181/264, 269, 270, 272, 273, 276, 282; 381/71, 94

[56] References Cited

U.S. PATENT DOCUMENTS

| | | | |
|---|---|---|---|
| 4,153,815 | 5/1979 | Chaplin et al. | 181/206 |
| 4,171,465 | 10/1979 | Swinbanks | 181/206 |
| 4,417,098 | 11/1983 | Chaplin et al. | 381/94 |
| 4,490,841 | 12/1984 | Chaplin et al. | 381/71 |
| 4,566,118 | 1/1986 | Chaplin et al. | 381/71 |
| 4,909,348 | 3/1990 | Harwood et al. | 181/282 |
| 5,044,464 | 9/1991 | Bremigan | 181/206 |
| 5,060,271 | 10/1991 | Geddes | 381/71 |
| 5,063,598 | 11/1991 | Geddes | 381/71 |
| 5,097,923 | 3/1992 | Ziegler et al. | 181/206 |

OTHER PUBLICATIONS

DIGISONIX ® Newsletter, Summer/Fall 1990, "Turn on the Quiet", Digital Sound Cancellation Systems, Stoughton, Wis.

The Courier-Journal, Louisville, Ky., pp. F1 and F4, "System Uses Sound to Cut Noise Levels in Vehicles", Jan. 19, 1990.

Body Chassis, "Tenneco, Noise Cancellation Tech Form Electronic Muffler Venture".

The Arizona Republic, pp. F1 and F7, "Anti-Noise: The Sounds of Silence Become Reality", Jan. 27, 1991.

The New York Times, Jan. 27, 1991, "New Technology Chips Away at Noise".

Top Express, Issue No. 3, 1990, "Topexpress Collaborating with Active Noise and Vibration"Technologies, Inc., Phoenix, Ariz.

New York Times, "Inventor Employs Chip Power to Minimize Automotive Noise".

(List continued on next page.)

*Primary Examiner*—Michael L. Gellner
*Assistant Examiner*—Khanh Dang
*Attorney, Agent, or Firm*—Barnes & Thornburg

[57] ABSTRACT

An active noise cancellation system is used to quiet engine exhaust noise. Combustion product from an engine passes through a conduit to an acoustical mixing chamber located in the tailpipe. A microphone senses noise in the vicinity of the tailpipe and provides a signal to a control unit. The control unit generates a controlling signal sent to one or more speakers mounted in a housing that is coupled to the tailpipe. Sound produced by the speakers enters the mixing chamber to mix with and cancel sound from the combustion product exiting he conduit. Some embodiments include a muffler housing forming an interior chamber which is divided into two sub-chambers. Other embodiments include a muffler having an outer housing enclosing an inner housing. Variations have been devised regarding the number of speakers mounted in each chamber and the way in which they are mounted. Generally, the speakers are attached to mounting brackets and oriented to direct sound waves generally toward the exit of the housing and into the mixing region located in the tailpipe.

64 Claims, 5 Drawing Sheets

OTHER PUBLICATIONS

Autoweek, Jul. 27, 1987, p. 30, "Shh! You Hear That?".
Sep. 1988 Ward's Auto World, p. 157, "Supplier Pipeline/What's New-Electronic Muffler".
"The Cancellation of Repetitive Noise and Vibration by Active Methods", GBB Chaplin, Noise Cancellation Technologies, Inc., Great Neck, N.Y., pp. 1-5.
Purdue University Perspective, p. 11, "Dueling Decibels Silence Sound".
The Arizona Republic, Jan. 10, 1991, "Vehicle Noise Control Tackled".
Inter-Noise, Newport Beach, Calif., Dec. 4-6, 1989, "Design of an Active Muffler for Internal Combustion Engines", pp. 471-479.
Electronic Attenuation of Noise and Vibration, 1987, Noise Cancellation Technologies, Inc. (4 pages).
Exhaust News, Oct. 15, 1988, p. 66, "Noise Cancellation Device, Stamped Muffler Under Development by Walker".
Science and Research News, Apr. 26, 1991, vol. 252, pp. 508-509, "Antinoise Creates the Sounds of Silence".
"DIGISONIX Component Installation", p. 7, date unknown.
Automotive Electronics News, Dec. 4, 1989, "Muffler Ventures Accelerate Development".

ELECTRONIC MUFFLER ASSEMBLY WITH EXHAUST BYPASS

This application is a continuation of 07/702 909,965 filed Jul. 7, 1992, now abandoned.

BACKGROUND AND SUMMARY OF THE INVENTION

The present invention relates generally to active noise cancellation systems, and particularly to active noise cancellation systems for use in quieting the engine exhaust noise of an internal combustion engine. More particularly, this invention relates to an exhaust processor assembly including a mixing chamber receiving combustion product generated by a vehicle engine and a housing containing noise cancellation speakers for delivering cancelling sound waves to the mixing chamber.

Until recently, mufflers used to silence vehicle engines have been limited to passive devices. In a conventional muffler, a stream of exhaust gases is routed from the engine into the muffler where it is generally directed through various flow obstacles such as tubes and baffles provided inside the muffler. The purpose of the flow obstacles in a muffler is to reflect a portion of the sound waves associated with the exhaust gases back towards the engine. The change of acoustic impedance causes the sound energy to be reduced.

The use of such conventional baffle arrangements causes back pressure to develop in the exhaust system. As the stream of exhaust gases encounter the baffles or other obstacles to flow, a pressure wave is propagated back through the exhaust system to the engine, requiring additional power from the engine just to expel the exhaust gases. This power requirement results in reduced maximum power available from a given engine while decreasing fuel efficiency. Therefore, a muffler that is configured to eliminate or substantially reduce back pressure in an exhaust system and includes an active noise attenuation device would represent a great improvement over conventional mufflers.

Active noise attenuation devices use acoustic sensors, control systems, and speakers or transducers to produce sound wave interference. Using sound wave interference, undesirable noise is attenuated by mixing cancelling sound waves produced by the active noise attenuation device with the undesirable noise. The cancelling sound waves are ideally the same frequency and amplitude as the undesirable noise produced by the engine exhaust, but 180 degrees out of phase. When sound waves of equal amplitude and frequency but opposite phase interact, they cancel. In an engine exhaust system equipped with an active noise attenuator, the cancelling sound waves produced by the attenuator mix with the sound waves associated with the exhaust gases traveling in an engine exhaust system to quiet the engine exhaust noise to an acceptable level.

It has been observed that various components in an active noise attenuation device are susceptible to damage as a result of exposure to excessive heat. For example, speakers used to produce cancelling sound waves could be damaged by exposure to heat from the exhaust gases radiated by an exhaust pipe. This exposure to heat can cause the speakers to overheat and the adhesive holding the speaker cones to the speaker frames to deteriorate, thereby allowing the speaker cones to separate from the speaker frame. Consequently, the effectiveness of the speakers in a hot active noise attenuation device could be reduced or completely compromised.

An improved active noise attenuation device would be thermally isolated from contact with the high heat of the combustion product produced by an engine and discharged through an exhaust system. Thermal isolation of the active noise attenuation device from hot combustion product would minimize heat damage to the device without sacrificing noise attenuation. Furthermore, the improved design could eliminate as many bends in the exhaust pipe as possible, along with removing the restrictive muffler, thereby reducing the back pressure applied to the engine.

According to the present invention, an exhaust processor assembly includes a housing formed to include an interior chamber and outlet means for emitting sound waves generated in the interior chamber. The assembly further includes means for providing an acoustical mixing chamber in acoustical communication with the outlet means, means for conducting combustion product from an engine to the acoustical mixing chamber, and means for producing sound waves to attenuate noise generated by combustion product introduced into the acoustical mixing chamber through the conducting means. The assembly further includes means for mounting the sound wave producing means in the interior chamber of the housing to partition the interior chamber to define a first sub-chamber receiving the sound waves generated by the sound wave producing means and having an opening communicating with the outlet means and a second sub-chamber providing a resonance chamber in spaced-apart relation from the outlet means.

In preferred embodiments, the mounting means includes a bracket coupled to the housing to partition the interior chamber of the housing into first and second sub-chambers. The sound producing means illustratively includes a pair of speakers mounted on the bracket and oriented to produce sound waves in the first sub-chamber. The sound waves produced in the first sub-chamber by the speakers are communicated to the acoustical mixing chamber through the outlet means. Illustratively, the two speakers are mounted on a V-shaped bracket so that they are aligned at an angle to one another and arranged to face toward the outlet means formed in the housing.

Advantageously, the hot noisy combustion product mixes with the noise attenuating sound waves produced by the speakers in the acoustical mixing chamber. This acoustical mixing chamber is located outside of the housing and away from the speakers (e.g., in the tail pipe). Heat damage to the speakers is minimized because the remote location of the speakers relative to the acoustical mixing chamber functions to protect the speakers from exposure to the hot noisy combustion product passing through the acoustical mixing chamber.

By providing an acoustical mixing chamber outside of the housing and in acoustical communication with the interior chamber and the conducting means, the improved exhaust processor assembly of the present invention causes noise generated by the engine combustion product to be cancelled in the acoustical mixing chamber outside the housing by the sound waves produced by the speakers in the remote interior chamber inside the housing. Furthermore, the noise cancellation can take place without requiring the hot engine combustion product to pass through the interior chamber and come into contact with the speakers mounted therein, thereby minimizing heat and corrosion related problems found in conventional electronic mufflers. By thermally insulating the acoustical mixing chamber from the outlet means of the interior chamber using a ring made of insulation material, heat generated by the engine combustion is restricted to the acoustical mixing chamber and is not passed back into the interior chamber containing the speaker through the outlet means. This reduces the operating temperature in the speaker environment inside the interior chamber of the housing to yield increased durability and longevity of the speakers, thereby providing an improvement over conventional electronic mufflers.

In other preferred embodiments, the exhaust processor assembly includes an outer housing having an interior chamber and a first outlet for emitting low-frequency sound waves generated by low-frequency speakers positioned in the interior chamber. It also has an inner housing having a second interior chamber and second outlet for emitting high-frequency sound waves generated by high-frequency speakers positioned in the second interior chamber. The inner housing is situated inside the outer housing to position the second outlet of the inner housing inside the first outlet of the outer housing.

By providing an inner housing inside the outer housing, certain embodiments in accordance with the present invention function to allow the production of high-frequency and low-frequency sound waves in two separate but acoustically connected chambers, advantageously maximizing use of available space. By using an acoustical mixing chamber separate from the inner and outer chambers, noise cancellation can take place without requiring the hot engine combustion product to pass through either one of the inner and outer chambers, thereby minimizing heat and corrosion related problems found in conventional electronic mufflers. By thermally isolating the acoustical mixing chamber from the inner and outer chambers using one or more rings made of insulation material, heat generated by the engine combustion is restricted to the acoustical mixing chamber and is not passed back into the chambers containing the speakers through the first and second outlets.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 2, 3:
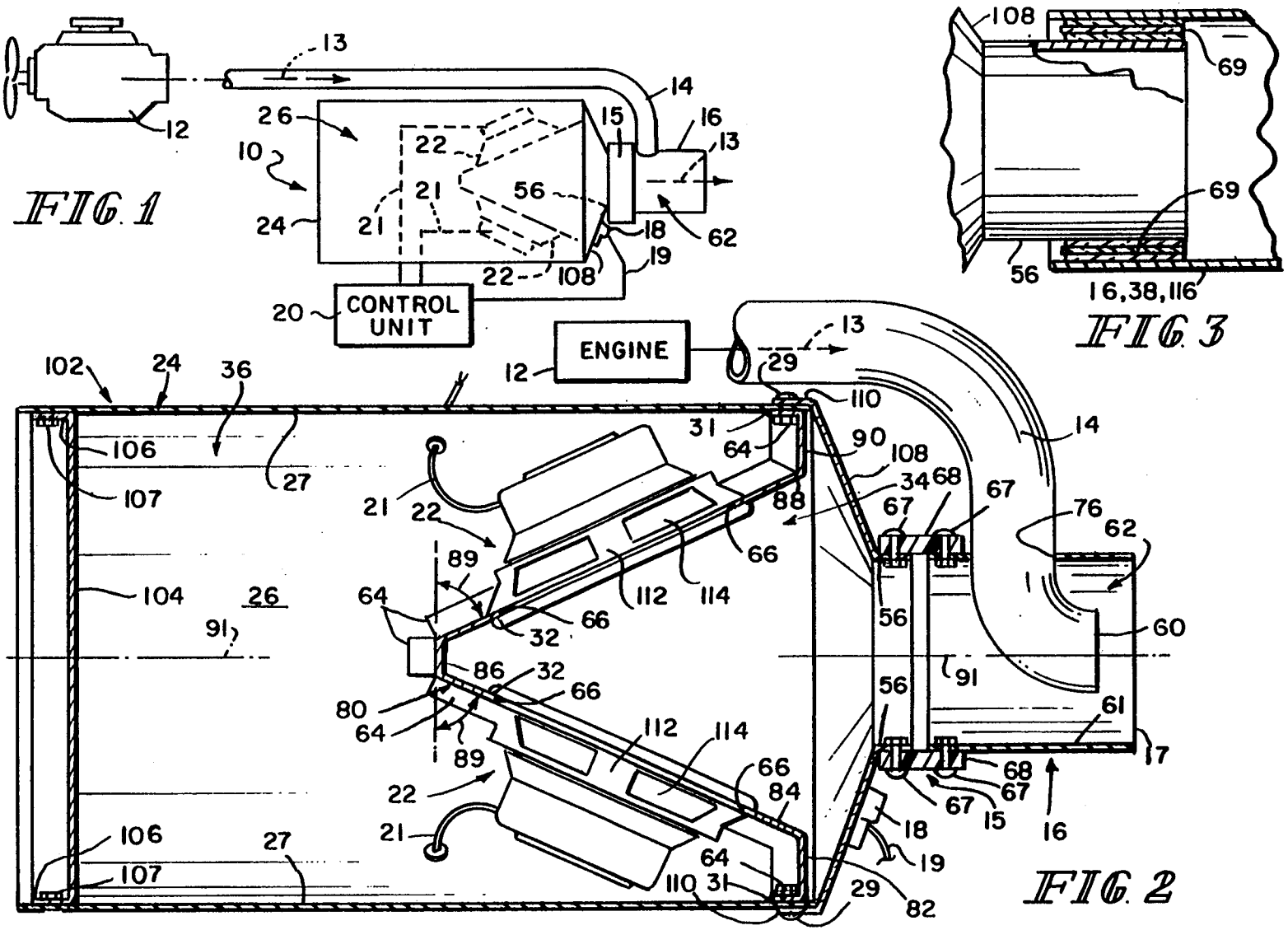
FIG. 1 is a schematic view of an exhaust noise processor assembly according to the present invention shown in relation to an engine.
FIG. 2 is a vertical section through a housing and outlet of the exhaust processor assembly of FIG. 1 showing a pair of speakers mounted on a partition provided within the housing, the speakers being aimed at the outlet.
FIG. 3 shows an alternative method of thermally isolating the exhaust processor assembly from the tail pipe.

An exhaust processor assembly 10 according to the present invention is shown diagrammatically in FIG. 1. Combustion product 13 from an engine 12 passes through an exhaust conduit 14 and exits the conduit 14 into an acoustical mixing chamber 62 located in a tail pipe 16. A microphone 18 senses noise in the vicinity of the tail pipe 16 (e.g. the noise associated with the combustion product 13 delivered by conduit 14 into acoustical mixing chamber 62) and provides a signal via an input lead 19 to a control unit 20. The control unit 20 uses the signal produced by the microphone 18 to generate a controlling signal sent via control leads 21 to speakers 22 mounted in a housing 24 that is coupled to tail pipe 16 at joint 15. Sound produced by the speakers 22 goes through outlet 56 near joint 15 and enters the mixing chamber 62, there to mix with, and cancel, sound from the combustion product 13 exiting the conduit 14. It will be appreciated that the speakers 22 can be any form of transducer (e.g., piezoelectric, hydraulic, etc. . . . ) capable of producing cancelling sound waves.

As shown best in FIG. 2, housing 24 is formed to include an interior chamber 26 containing the speakers 22 and having an outlet 56 coupled to tail pipe 16 at joint 15. The housing 24 is illustratively a "stuffed can" having a side wall 102, an end plate 104 having a flange 106 attached to the side wall 102 by screws 107 or other suitable fastening means, and an outlet cone 108 having a flange 110 attached to the side wall 102 by screws 29 or other suitable means. The outlet cone 108 is formed to include the reduced diameter outlet 56 as shown in FIG. 2. Very small drainage holes (not shown) can be provided in the housing 24 to allow drainage of moisture that forms or collects inside the housing 24. Preferably, the drainage holes, less than 0.375 inch (0.95 cm) in diameter, would not have a major impact on the acoustic properties of the exhaust processor assembly 10.

It will be appreciated that it is within the scope of the present invention to replace housing 24 with a housing of the clamshell type. In a clam shell type housing, the housing 24 would be formed from two shell halves similar to shell halves 292 and 294 shown illustratively in FIG. 10. The shell halves are joined together at mating flanges similar to mating flanges 293 and 295 shown illustratively in FIGS. 10 and 11.

Referring again to FIG. 2, a bracket 80 is mounted inside housing 24 to divide the interior chamber 26 of housing 24 into a first sub-chamber 34 communicating with outlet 56 and a second sub-chamber 36 situated at the opposite end of housing 24 in spaced-apart relation to outlet 56. A skirt 64 extends along the perimeter of the bracket 80. The skirt 64 includes a series of sections, with a section associated with each segment of the bracket 80. Each skirt section is orthogonal to its associated bracket segment. The skirt 64 contacts an inner surface 27 of the housing 24 and is attached thereto by bolts 29, welding, or other suitable fastening means. The resulting border 31 between the skirt 64 and the housing 24 is sealed. It will be understood that the shape and size of the bracket 80 and flange 64 could be modified as necessary to fit easily within a clamshell housing.

Figure 4:
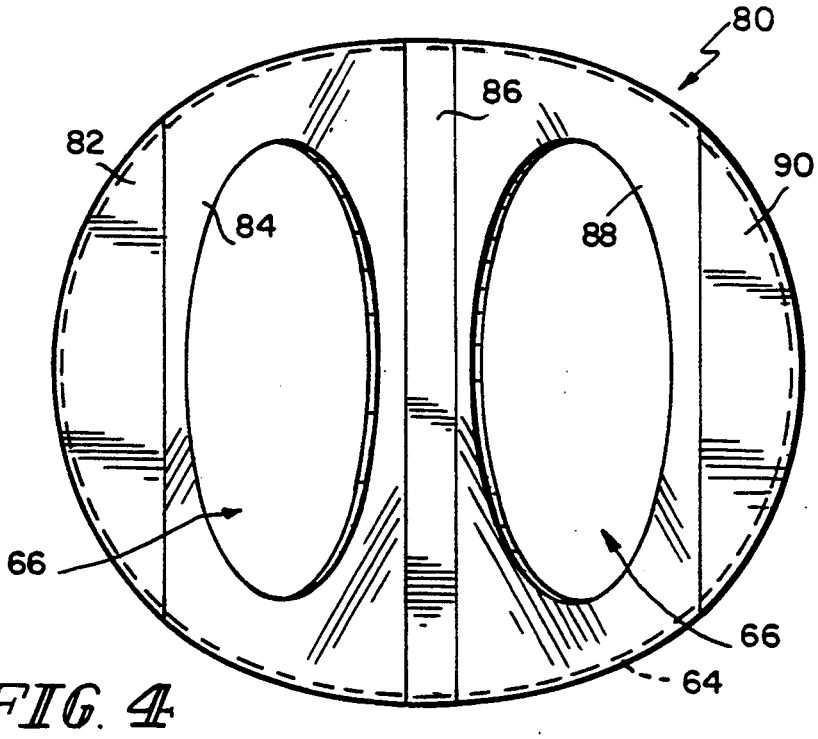
FIG. 4 is a plan view of the partition illustrated in the embodiment of FIGS. 1 and 2.

The bracket 80 is bent as necessary to form a continuous and unbroken sequence of segments 82, 84, 86, 88, and 90 as shown in FIGS. 2 and 4. Segments 82, 86, and 90 are parallel to each other, with segment 90 being coplanar with segment 82. Segments 84 and 88 subtend equal angles 89 with segment 86 as shown best in FIG. 2 and speaker-receiving apertures 66 are formed in segments 84 and 88 as shown best in FIG. 4.

In a preferred embodiment, speakers 22 are provided wherein each has a frequency response of approximately 30–700 Hz. Each speaker 22 has a frame 112 and a diaphragm 114 coupled to the frame 112 as shown best in FIG. 2. The speaker frames 112 are mounted to the bracket 80 by riveting, welding or other suitable fastening means and positioned so as to cover the apertures 66 formed in bracket segments 84 and 88. The speakers 22 are mounted so as to be positioned substantially inside closed second sub-chamber 36 with the diaphragms 114 opening to face into the first sub-chamber 34, thereby directing cancelling sound waves from the speakers 22 towards the outlet 56. The resulting border 32 between the speaker frames 112 and the bracket 80 is sealed so that the speakers 22 cooperate with the bracket 80 to seal the second sub-chamber 36 and make it a closed chamber.

The speakers 22 are preferably four inches (10.16 cm) to eleven inches (27.94 cm) in diameter, but it will be understood that other sizes and shapes such as oval or polygonal may be acceptable. The speakers 22 should be of a rugged variety capable of operation in the automotive environment. This could entail use of speaker cones made from plastic, KEVLAR®, fiberglass mat, or other material that would be relatively impervious to vibration and the extreme temperatures likely to be encountered. It will be appreciated that the speakers 22 can be any device capable of producing cancelling sound waves in response to an input.

The angle 89 between segments 86 and each of segments 84 and 88 and shown in FIG. 2 is determined by the size of the speakers 22 used. The shape of bracket 80 must be modified by making angle 89 larger in order to fit larger segments 84 and 88 on bracket 80 and within the housing 24. One objective is to size, mount, and arrange the speakers to direct the cancelling sound waves from the speakers 22 generally in a direction toward the outlet 56 and as nearly as possible in a direction along the longitudinal axis 91 of the exhaust processor assembly 10 as shown in FIG. 2.

In a fashion similar to a resonance cavity, the closed second sub-chamber 36 helps to improve the low end frequency response of the speakers 22. A reduction in the volume of the closed second sub-chamber 36 reduces the low end response, and conversely, an increase in the closed volume improves the response. However, it has been found that the closed volume can be reduced to a minimum by moving the end plate 104 inwardly toward the speakers 22, and while this tends to degrade the low end response of the speakers 22 somewhat, the degradation is not prohibitive. Therefore, it will be appreciated that the placement of the bracket 80 within the interior chamber 26 is a result of balancing several factors such as amount of low end response needed from the speakers 22 and space limitations imposed by the particular application.

Cancelling sound waves from speakers 22 exit through the outlet 56 and enter the mixing chamber 62 located in the tail pipe 16. Bolts 67 attach the outlet 56 and tail pipe 16 to the coupler 68. The outlet 56 is coupled to the tail pipe 16 at joint 15 by a thermally insulative coupler 68. The coupler 68 thermally isolates the exhaust processor assembly 10 from the heat of the exhaust gases 13, thereby providing a major improvement over previous exhaust processors. TEFLON® has been found to be a suitable material for use in the couplers 68, but any thermal insulating material can be used. For instance, a fiberglass mat 69 can be wrapped several times around the outlet 56, and the tail pipe 16 can be fitted over the outlet 56 as shown illustratively in FIG. 3.

At least one microphone 18 is mounted on the outlet cone 108 as shown in FIG. 2. The microphone 18 senses the engine exhaust sound in the vicinity of the mixing chamber 62 and tail pipe 16 and sends a signal representative of the engine exhaust sound to a control unit 20 via an input lead 19. The control unit 20 uses that signal to generate a control signal which is sent to the speakers 22 via a control lead 21. The control signal causes the speakers 22 to emit cancelling sound waves to cancel the sound produced by the engine exhaust 13 and detected by the microphone 18.

It will be understood that the purpose of the microphone 18 is to detect the sound in the vicinity of the mixing chamber 62 and/or the tail pipe 16, and therefore other microphones and other locations on or near the exhaust processor assembly 10 can be used with suitable results. Also, one or more microphones 18 can be mounted on the automobile bumper (not shown), muffler assembly 10, or anywhere else within the vicinity of the mixing chamber 62.

The tail pipe 16 includes a side aperture 76 formed and sized to receive the exhaust conduit 14 that is connected to the engine 12 as shown in FIG. 2. The exhaust conduit 14 conducts combustion product 13 from the engine 12 and is formed and bent as necessary to allow the conduit 14 to extend through the side aperture 76 and terminate coaxially with and inside the tail pipe 16. The outlet end 60 of the conduit 14 forms an open mouth lying in the passage 61 formed in the tail pipe 16 and communicating physically and acoustically with the mixing chamber 62.

Figure 5:
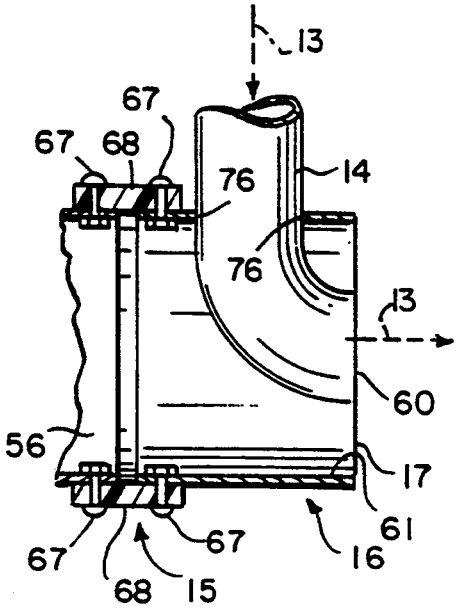
FIG. 5 shows an alternative tail pipe arrangement wherein the end of the exhaust conduit is flush with the tailpipe outlet.
Figure 6:
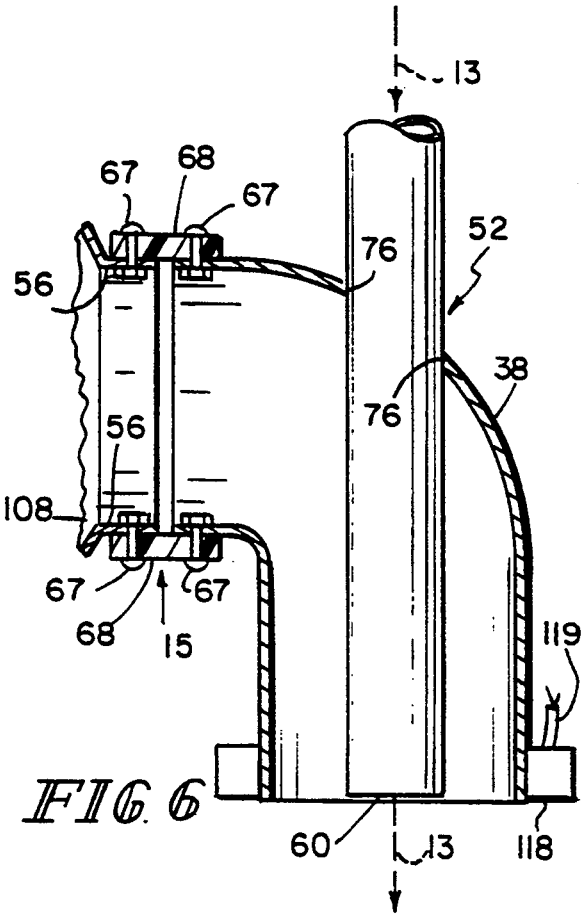
FIG. 6 shows another alternative tail pipe arrangement wherein the tailpipe is bent to allow a straight exhaust conduit to be used.

Illustratively, the outlet end 60 of the conduit 14 lies inside the exit 17 of the tail pipe 16 and about one inch (2.54 cm) inward from the tail pipe exit 17. However, the outlet end 60 of the conduit can be flush with the tail pipe exit 17, as shown illustratively in FIG. 5. Alternatively, as shown illustratively in FIG. 6, the tail pipe 38 can be bent to allow an exhaust conduit 52 to remain straight and unbent, thereby advantageously further reducing back pressure on the exhaust system. In the embodiment of FIG. 6, the outlet end 60 of the conduit 52 can also be spaced inwardly inside the tail pipe 38 or flush with the outlet end of the tail pipe 38.

Figure 7:
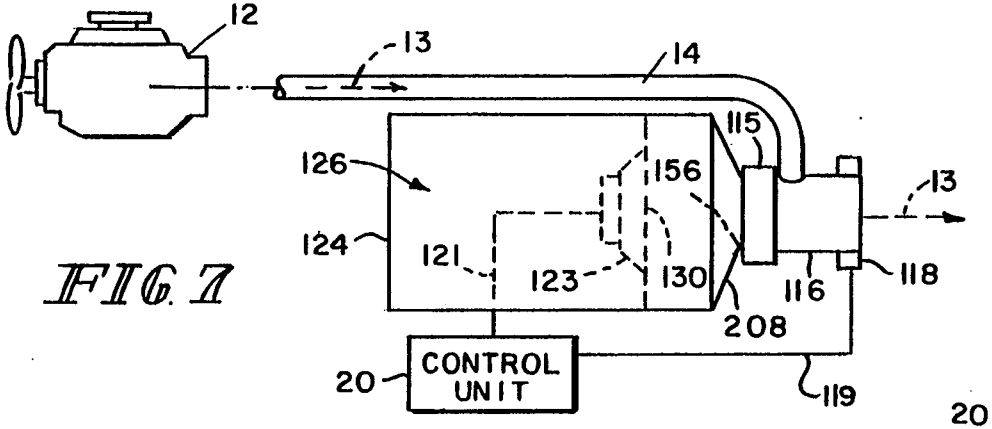
FIG. 7 is a schematic view of an alternative embodiment of an exhaust processor assembly shown in relation to an engine.
Figure 8:
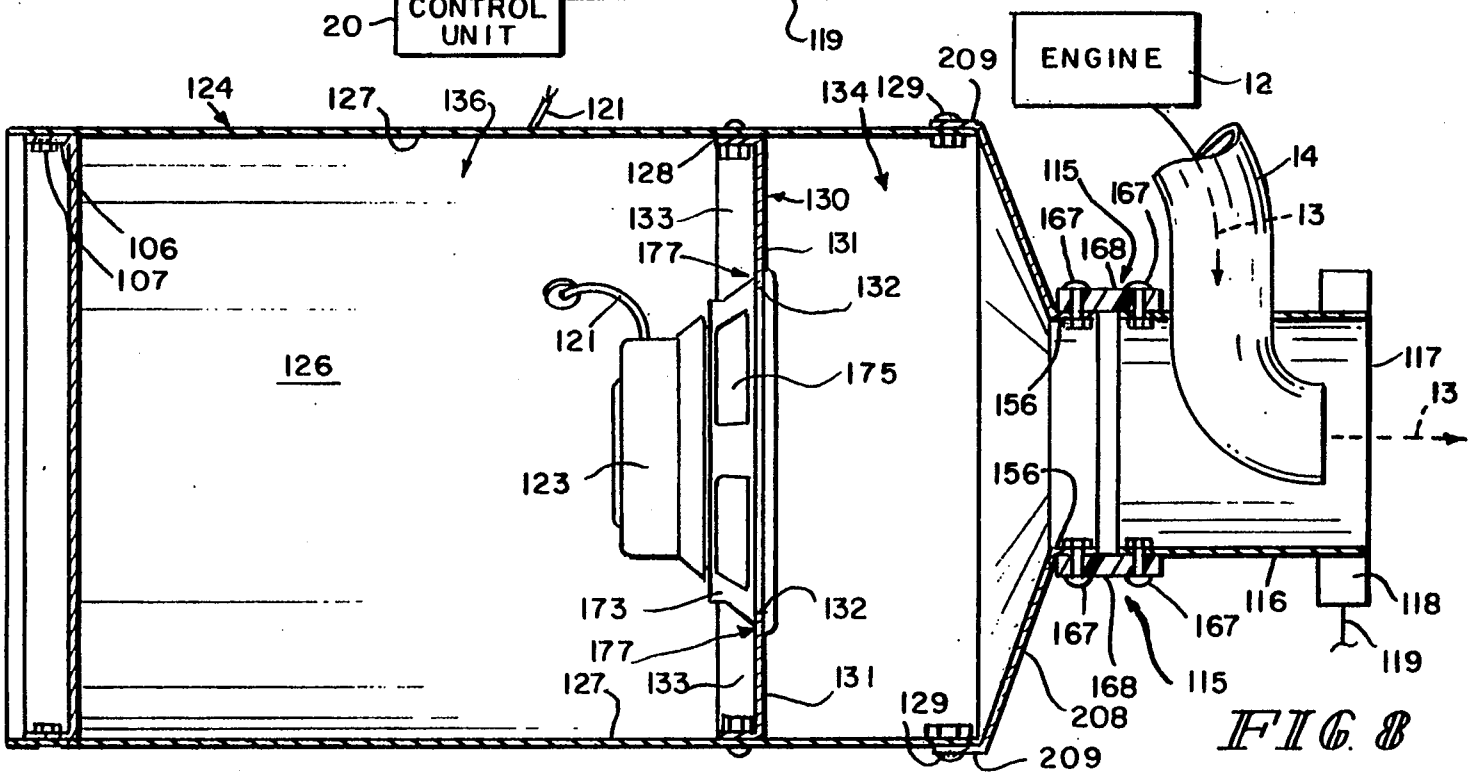
FIG. 8 is a vertical section through the exhaust processor assembly of FIG. 7 showing a single speaker mounted on a partition provided within the housing and aimed at the outlet.

An alternative embodiment of the invention is shown illustratively in FIGS. 7 and 8. Housing 124 is formed to include an interior chamber 126 having an outlet 156 coupled to tail pipe 116 at joint 115. A thermally insulative coupling 168 is attached by bolts 167, or other suitable fastening means, to the outlet 156 and the tail pipe 116. The housing 124 is illustratively a "stuffed can" having a side wall 102, an end plate 104 having a flange 106 attached to the side wall 102 by bolts 107 or other suitable fastening means, and an outlet cone 208 having a flange 209 attached to the side wall 102 by bolts 129 or other suitable fastening means. The outlet cone 208 is formed to include a reduced diameter outlet 156. The embodiment of FIGS. 7 and 8, unlike that of FIGS. 1 and 2, uses a single speaker 123 and a flat mounting bracket 130.

The mounting bracket 130 divides the interior chamber 126 into a first sub-chamber 134 and a second sub-chamber 136. The mounting bracket 130 comprises a flat plate 131 formed to include an aperture 132 and a skirt 133. The skirt 133 extends along the perimeter of the flat plate 131 and projects orthogonally to the flat plate 131. The mounting bracket 130 is sized to fit snugly inside the housing 124. The skirt 133 contacts the inner surface 127 of the housing 124 and is attached thereto by welding or other suitable fastening means, and thereby divides the interior chamber 126 into a first sub-chamber 134 and a second sub-chamber 136. The resulting border 128 between the skirt 133 and the housing 124 is sealed by applying any sealant (not shown) that is appropriate to the environment. Although the housing 124 is illustratively a stuffed can type housing, it will be appreciated that the housing 124 could also be of the clamshell type. It will be understood that the size and shape of bracket 130 and skirt 133 can be modified to fit easily within a clamshell type housing.

In a preferred embodiment, a speaker 123, with a frequency response of approximately 10–700 Hz is provided. The speaker 123 is formed to include a frame 173 attached to a diaphragm 175. The frame 173 is attached to the mounting bracket 130 by riveting, welding or other suitable fastening means and positioned so as to cover the aperture 132 formed on the mounting bracket 130. The speaker 123 is mounted so as to be inside the second sub-chamber 136 with the speaker 123 facing the first sub-chamber 134, thereby directing cancelling sound waves from the speaker 123 towards the outlet 156. The resulting border 177 between the speaker frame 173 and the mounting bracket 130 is sealed (sealant not shown) so that the speaker 123 and the mounting bracket 130 cooperate to seal the second sub-chamber 136 and make it a closed chamber. It will be appreciated that the speaker 123 can be any form of transducer capable of producing cancelling sound waves.

In a fashion similar to a resonance cavity, the closed second sub-chamber 136 helps to improve the low end frequency response of the speaker 123. A reduction in the volume of the closed second sub-chamber 136 reduces the low end response, and conversely, an increase in the closed volume improves the response. However, it has been found that the closed volume can be reduced to a minimum by moving the end plate 104 nearer to the speaker 123, and while this tends to degrade the low end response of the speaker 123 somewhat, the degradation is not prohibitive. Therefore, it will be appreciated that the placement of the mounting bracket 130 within the interior chamber 126 is a result of balancing several factors such as amount of low end response needed from the speaker 123 and space limitations imposed by the particular application.

It will be further appreciated that the invention is not limited only to the number of speakers and apertures described. For example, two or more smaller apertures 86 could be formed on each segment 84 and 88 of FIG. 2, thereby allowing for two or more smaller speakers 22 to be mounted on the same size mounting bracket 80. Two or more smaller holes could also be formed on the mounting bracket 130 to accommodate two or more smaller speakers 123 to be mounted to the same size bracket 130. It should be further understood that the mounting bracket geometry is not limited to flat plates or V-shape, but could be, for example, a modified pyramid or a hemisphere. It will be further appreciated that the alternative outlet arrangements of FIGS. 5 and 6 could apply equally well to the embodiment of FIGS. 7 and 8.

Figure 9:
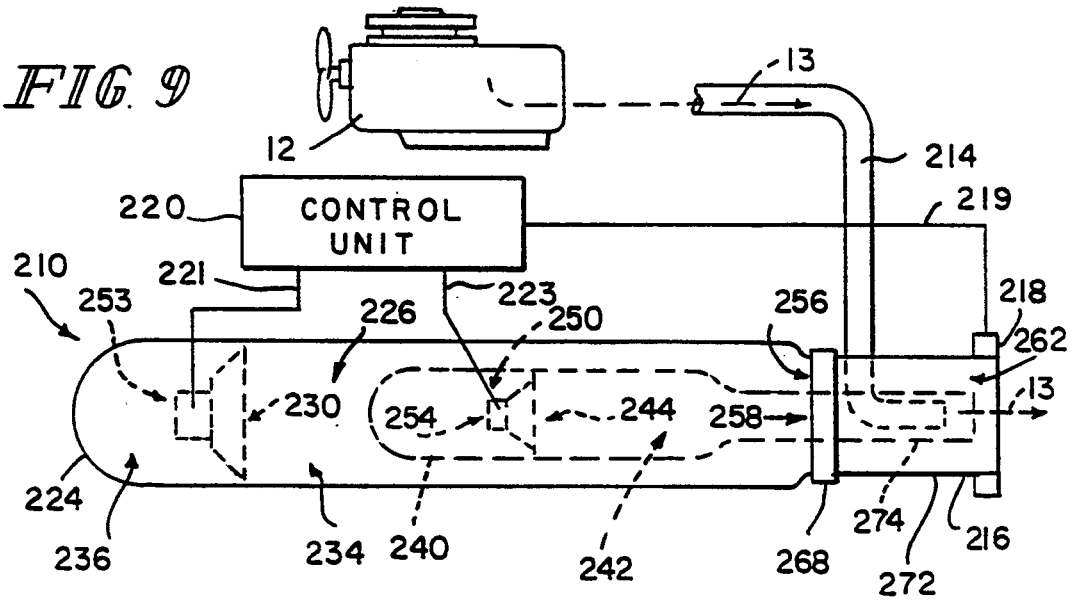
FIG. 9 is a schematic of yet another embodiment of an exhaust processor assembly shown in relation to an engine, the assembly including an inner housing containing a first speaker and an outer housing containing the inner housing and a second speaker outside of the inner housing.
Figure 10:
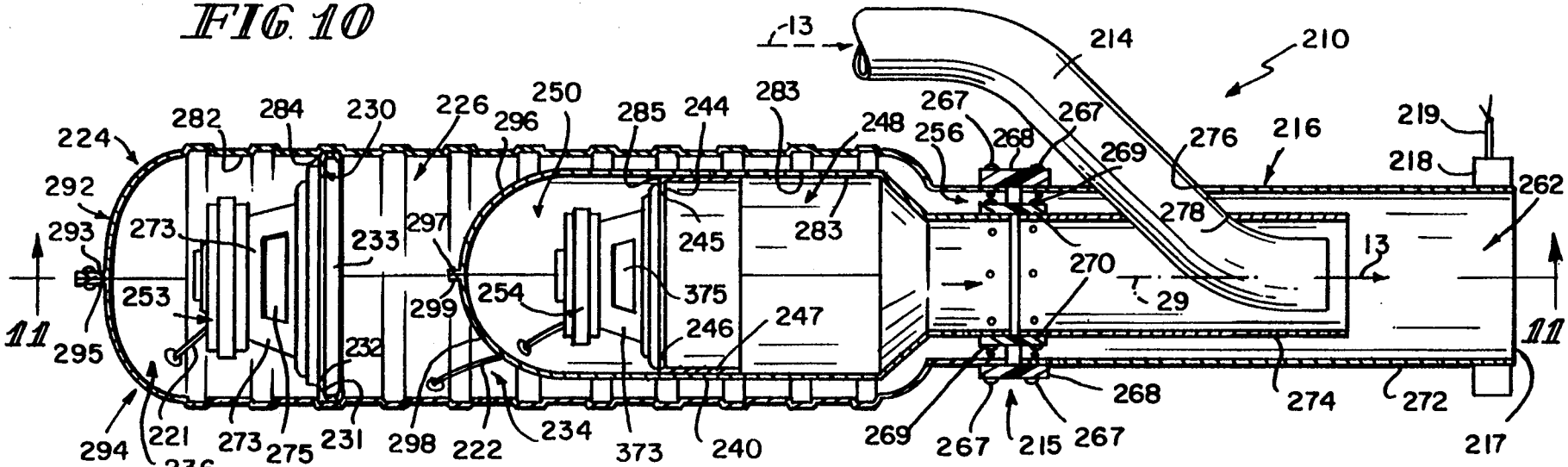
FIG. 10 is a vertical section through the exhaust processor assembly of FIG. 9.
Figure 11:
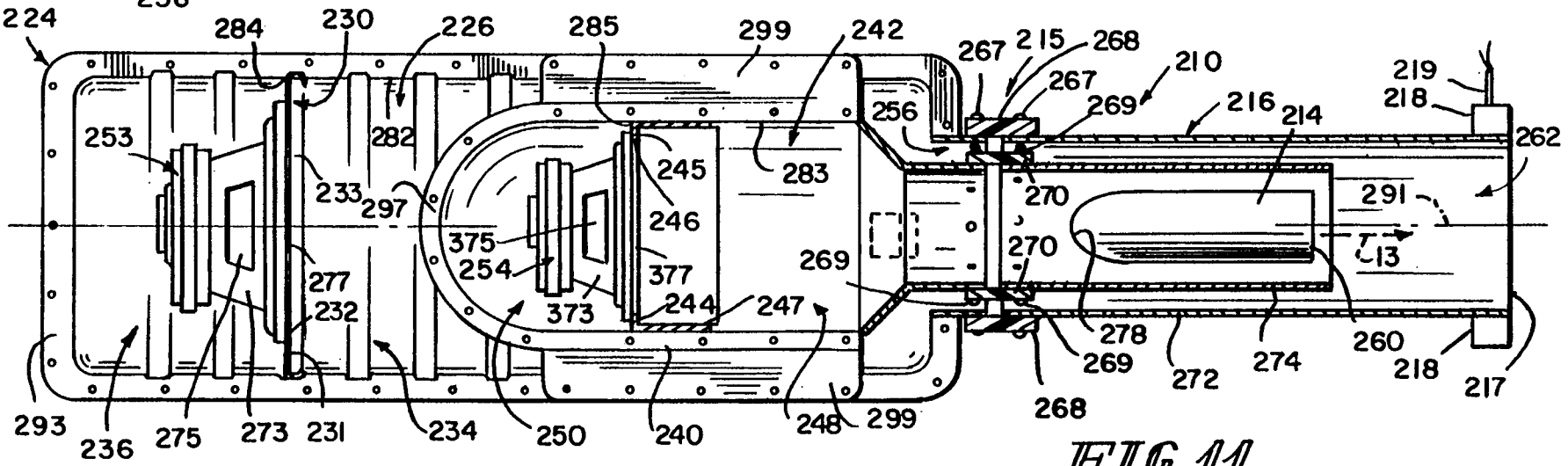
FIG. 11 is a horizontal section through the exhaust processor assembly of FIG. 9.

According to the alternative embodiment of the invention as shown illustratively in FIGS. 9–11, the electronic muffler assembly 210 comprises an outer housing 224 defining a first interior chamber 226, and an inner housing 240 defining a second interior chamber 242. The outer housing 224 is illustratively a clamshell type housing, having a top shell half 292 having a mating flange 293 and a lower shell half 294 having a mating flange 295. The shell halves 292, 294 are joined together at the mating flanges 293, 295 by welding or other suitable fastening means. The mated shell halves 292 and 294 cooperate to define a first outlet 256. Although a clamshell housing is preferred, alternative housing designs such as the stuffed can type can be used.

A first mounting bracket 230 divides the first interior chamber 226 into a first sub-chamber 234 and a second sub-chamber 236. The first mounting bracket 230 comprises a flat plate 231 formed to include an aperture 232 and a skirt 233. The skirt 233 extends along the perimeter of the flat plate 231 and projects orthogonally to the flat plate 231. The mounting bracket 230 is sized to conformingly fit inside the outer housing 224 when the clamshell halves 292, 294 are closed. The skirt 233 contacts the inner surface 282 of the outer housing 224 and is attached thereto by welding or other suitable fastening means, and thereby divides the first interior chamber 226 into the first sub-chamber 234 and the second sub-chamber 236. The resulting border 284 between the skirt 233 and the inner surface 282 of the outer housing 224 is sealed by applying a sealant (not shown) that is appropriate to the environment.

A low-frequency speaker 253 with a frequency response of approximately 10–250 Hz is formed to include a frame 273 attached to a diaphragm 275. The frame 273 is attached to the first mounting bracket 230 by riveting, welding, or other suitable fastening means and positioned so as to cover the aperture 232. The low-frequency speaker 253 is mounted so as to be inside the second sub-chamber 236 with the speaker 253 facing toward the first sub-chamber 234, thereby directing cancelling sound waves from the low-frequency speaker 253 toward the first outlet 256. The resulting border 277 between the speaker 253 and the mounting bracket 230 is sealed (sealant not shown) so that the speaker 253 and the mounting bracket 230 cooperate to seal the second sub-chamber 236 and make it a closed chamber.

In a fashion similar to a resonance cavity, the closed second sub-chamber 236 helps to improve the low end frequency response of the speaker 253. A reduction in the volume of the closed second sub-chamber 236 reduces the low end response, and conversely, an increase in the closed volume improves the response. However, it has been found that the closed volume can be reduced to a minimum, and while this tends to degrade the low end response of the speaker 253 somewhat, the degradation is not prohibitive. Therefore, it will be appreciated that the placement of the mounting bracket 230 within the first interior chamber 226 is a result of balancing several factors such as amount of low end response needed from the speaker 253 and space limitations imposed by the particular application.

The inner housing 240 is also of the clamshell type, having a top shell half 296 having a mating flange 297 and a bottom shell half 298 having a mating flange 299. The shell halves 296, 298 are joined together at the mating flanges 297, 299 which are then nested within the mating flanges 293, 295 of the outer housing 224, so that the inner housing 240 is thereby supported within the outer housing 224. The outer housing mating flanges 293, 295 are formed to fit snugly over the inner housing mating flanges 297, 299. When the mating flanges are nested, they are joined together by welding or other suitable fastening means. The mated shell halves 296 and 298 cooperate to define a second outlet 258 that is positioned inside the first outlet 256 and coaxial therewith.

A second mounting bracket 244 divides the second interior chamber 242 into a third sub-chamber 248 and fourth sub-chamber 250. The second mounting bracket 244 comprises a flat plate 245 formed to include an aperture 246 and a skirt 247. The skirt 247 extends along the perimeter of the flat plate 245 and projects orthogonally to the flat plate 245. The mounting bracket 244 is sized to fit snugly inside the inner housing 240 when the clamshell halves 296, 298 are closed. The skirt 247 contacts the smooth inner surface 283 of the inner housing 240 and is attached thereto by welding or other suitable fastening means, and thereby divides the second interior chamber 242 into a third sub-chamber 248 and a fourth sub-chamber 250. The resulting border 285 between the skirt 247 and the inner surface 283 of the inner housing 240 is sealed by applying any sealant (not shown) that is appropriate to the environment.

A high-frequency speaker 254 with a frequency response of about 250–700 Hz is formed to include a frame 373 and a diaphragm 375. The frame 373 is mounted by riveting, welding, or other suitable fastening means to the second mounting bracket 244 and positioned so as to cover the aperture 246. The high-frequency speaker 254 is mounted so as to be inside the fourth sub-chamber 250 with the speaker 254 facing toward the third sub-chamber 248, thereby directing cancelling sound waves from the high-frequency speaker 254 toward the second outlet 258. The resulting border 377 between the speaker 254 and the mounting bracket 244 is sealed (sealant not shown) so that the speaker 254 and the mounting bracket 244 cooperate to seal the fourth sub-chamber 250 and make it a closed chamber.

As in the case of the closed second sub-chamber 236, the closed fourth sub-chamber 250 helps to improve the low end frequency response of the speaker 254. Again, as in the case of the low-frequency speaker 253, placement of the mounting bracket 244 within the second interior chamber 242 is the result of balancing several factors to arrive at an optimum solution for a particular application.

Cancelling sound waves from the speakers 253 and 254 exit through the first and second outlets 256 and 258, respectively, and enter the mixing chamber 262 located in the tail pipe 216. The tail pipe 216 comprises an outer tube 272 and an inner tube 274. The first outlet 256, which is a necked down portion of the outer housing 224, is coupled to the outer tube 272 at joint 215 by a thermally insulative coupler 268 by bolts 267 or other suitable fastening means. The second outlet 258, which is a necked down portion of the second inner housing 240 is coupled in a similar fashion to the inner tube 274 by a thermally insulative coupling 270 using bolts 269. The insulative couplers 268 and 270 are concentric and coaxially located along the longitudinal axis of the muffler assembly 210. TEFLON® has been found to be suitable material for use in the couplers, but any thermal insulating material can be used. For example, a fiberglass mat can be wrapped around the first and second outlets in a fashion similar to that shown illustratively in FIG. 3, and the outer tube 272 and the inner tube 274 can be fitted over the first outlet 256 and the second outlet 258, respectively.

The outer tube 272 has a side aperture 276 and the inner tube 274 has a side aperture 278 that lies adjacent to the outer tube side aperture 276. The conduit 214 for conducting combustion product 13 from the engine 12 is formed and bent as necessary to allow the conduit 214 to extend through the side apertures 276, 278 and terminate coaxially inside the inner tube 274. The outlet end 260 of the conduit 214 forms an open mouth lying in the passage formed by the inner tube 274 with the open mouth facing the mixing chamber 262. Illustratively, the inner tube 274 and the outlet end 260 of the conduit 214 terminate inside the tail pipe exit 217. However, it will be appreciated that either or both of the inner tube 274 and the outlet end 260 can terminate flush with the tail pipe exit 217.

A microphone 218, illustratively a ring type microphone, is shown located near the distal end of the tail pipe 216. The microphone 218 senses the sound in the mixing chamber 262 and sends a signal representative of the engine exhaust sound via an input lead 219, to a control unit 220. The control unit 220 uses that signal to generate a control signal which is sent via control leads 221 and 223 to the speakers 253 and 254, respectively. The control signal causes the speakers 253 and 254 to emit cancelling sound waves to cancel the sound detected by the microphone 218. It will be understood that the purpose of the microphone 218 is to detect the sound in the vicinity of the mixing chamber 262 and/or the tail pipe 216, and therefore other microphones and other locations on or near the exhaust processor assembly 210 can be used with suitable results.

Figure 12:
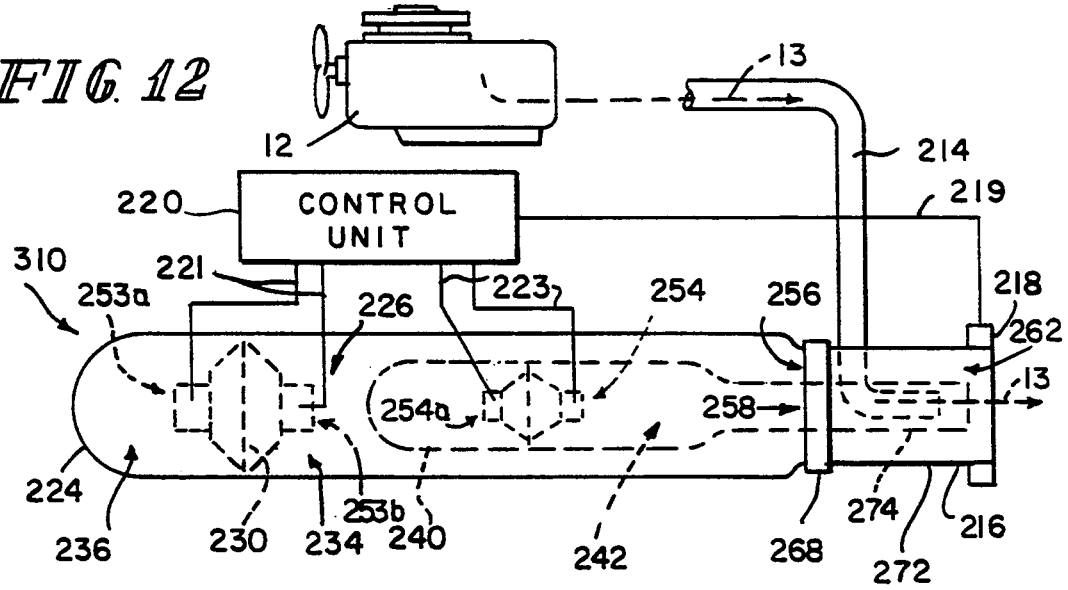
FIG. 12 is a schematic of still another embodiment of an exhaust processor assembly shown in relation to an engine, the assembly including an inner housing containing a first pair of speakers and an outer housing containing the inner housing and a second pair of speakers outside of the inner housing.

In another embodiment of the invention, as shown in FIG. 12, an electronic muffler assembly 310 comprises an outer housing 224 defining a first interior chamber 226, and an inner housing 240 defining a second interior chamber 242. The outer housing 224 is illustratively a clamshell type housing similar to that shown in FIGS. 10 and 11, having a top shell half having a mating flange and a lower shell half having a mating flange. The shell halves are joined together at the mating flanges by welding or other suitable means. The mated shell halves cooperate to define a first outlet 256. Although a clamshell housing is preferred, alternative housing designs such as the stuffed can type can be used.

A first mounting bracket 230 divides the first interior chamber 226 into a first sub-chamber 234 and a second sub-chamber 236. Two low-frequency speakers 253 and two high-frequency speakers 254 are used in the embodiment of FIG. 12. The low-frequency speakers 253, each with a frequency response of approximately 30–250 Hz, are mounted to the first mounting bracket 230. A first speaker **253*a* is mounted so as to be located within the closed second sub-chamber 236 with the first speaker 253*a* facing toward the first sub-chamber 234. A second speaker 253*b* is mounted so as to be located within the first sub-chamber 234 with the second speaker 253*b* facing toward the second closed sub-chamber 236, thereby positioning the first and second speakers 253*a,b* in face-to-face confronting relation as shown diagrammatically in FIG. 12**.

The inner housing 240 is also of the clamshell type, having a top shell half having a mating flange and a bottom shell half having a mating flange. The shell halves are joined together at the mating flanges which are then nested within the mating flanges of the outer housing, so that the inner housing 240 is thereby supported within the outer housing 224. The outer housing mating flanges are formed to conformingly fit over the inner housing mating flanges. When the mating flanges are nested, they are joined together by welding or other suitable fastening means. The mated shell halves cooperate to define a second outlet 258.

A second mounting bracket 244 divides the second interior chamber 242 into a third sub-chamber 248 and fourth sub-chamber 250. Two high-frequency speakers 254, each with a frequency response of about 250–700 Hz are mounted to the second mounting bracket 244 as shown diagrammatically in FIG. 12. A first speaker **254*a* is mounted so as to be located within the closed fourth sub-chamber 250 with the first speaker 254*a* facing toward the third sub-chamber 248. A second speaker 254*b* is mounted so as to be located within the third sub-chamber 248 with the second speaker 254*b* facing toward the closed fourth sub-chamber 250, thereby positioning the first and second speakers 254*a,b* in face-to-face confronting relation as shown diagrammatically in FIG. 12**.

Figure 13:
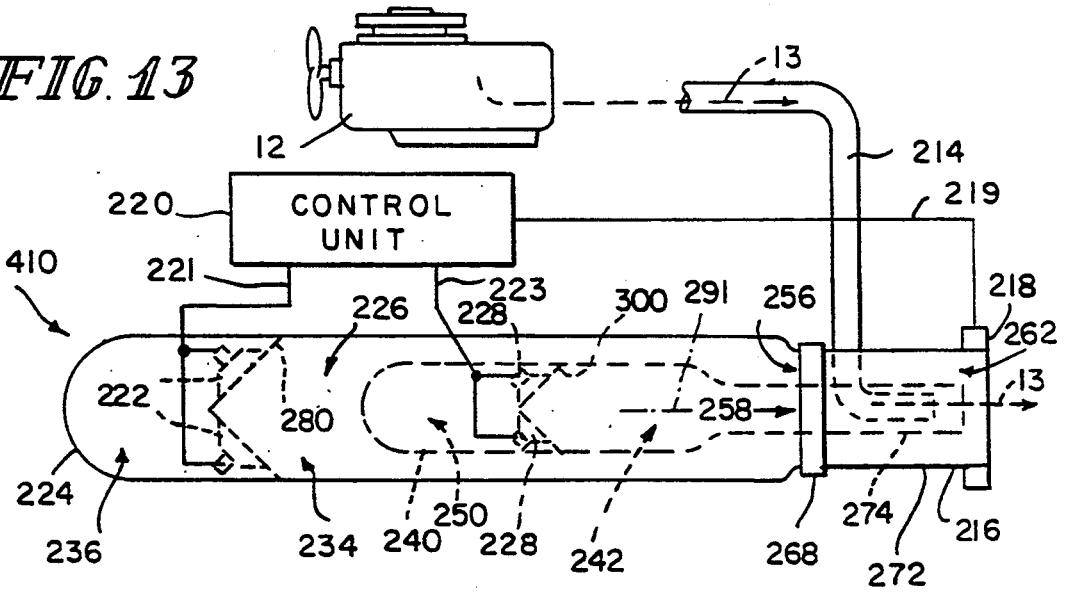
FIG. 13 is a schematic of still another embodiment of an exhaust processor assembly shown in relation to an engine, the assembly including an inner housing containing a first pair of angle mounted speakers and an outer housing containing the inner housing and a second pair of angle mounted speakers outside of the inner housing.

Yet another embodiment of the invention is shown in FIG. 13. An exhaust processor assembly 410 comprises an outer housing 224 defining a first interior chamber 226 and an inner housing 240 defining a second interior chamber 242. The outer housing 224 is illustratively a clamshell type housing, having a top shell half having a mating flange and a lower shell half having a mating flange. The shell halves are joined together at the mating flanges by welding or other suitable means. The mated shell halves cooperate to define a first outlet 256. Although a clamshell housing is preferred, alternative housing designs such as the stuffed can type can be used.

The embodiment of FIG. 13, however, uses two low-frequency speakers 222, each with a frequency response of approximately 10–250 Hz, two high-frequency speakers 228, each with a frequency response of approximately 250–700 Hz, and generally V-shaped mounting brackets 280 and 300. The mounting brackets 280 and 300 are configured and mounted in a fashion similar to the mounting bracket 80 of the embodiment of FIGS. 1, 2, and 4.

A first mounting bracket 280 divides the first interior chamber 226 into a first sub-chamber 234 and a second sub-chamber 236. Two low-frequency speakers 222, each with a frequency response of approximately 10–250 Hertz, are mounted to the mounting bracket 280 in a fashion similar to that used in FIGS. 1 and 2. The objective of the speaker arrangement is to direct the cancelling sound waves from the speakers 222 generally in a direction toward the first outlet 256 as shown diagrammatically in FIG. 13.

The inner housing 240 is also of the clamshell type, having a top shell half having a mating flange and a bottom shell half having a mating flange. The shell halves are joined together at the mating flanges which are then nested within the mating flanges of the outer housing 224, so that the inner housing 240 is thereby supported within the outer housing 224. The outer housing mating flanges are formed to conformingly fit over the inner housing mating flanges. When the mating flanges are nested, they are joined together by welding or other suitable means. The mated shell halves cooperate to define a second outlet 258.

A second mounting bracket 300 divides the second interior chamber 242 into a third sub-chamber 248 and a fourth sub-chamber 250. Two high-frequency speakers 228, each with a frequency response of approximately 250–700 Hertz, are mounted to the mounting bracket 300 in a fashion similar to that used in FIGS. 1 and 2. The objective of the speaker arrangement is to direct the cancelling sound waves from the speakers 228 generally in a direction toward the second outlet 258 as shown diagrammatically in FIG. 13.

It will be understood that the invention is not limited to the number of speakers and apertures described. It should be further understood that the mounting bracket geometry is not limited to flat plates or V-shape, but could be, for example, a modified pyramid or a hemisphere. Furthermore, it will be understood that the speakers 222, 228, 253, and 254 can be any form of transducer capable of producing cancelling sound waves.

By providing an inner housing 240 inside the outer housing 224, the present invention allows the production of high-frequency and low-frequency sound waves in two separate but acoustically connected chambers 226 and 242, advantageously maximizing use of available space. By using thermally isolated mixing chamber 262 separate from the inner and outer chambers 226 and 242, respectively, noise cancellation can take place without requiring the hot engine combustion product 13 to pass through the inner and outer chambers 226 and 242, thereby minimizing heat and corrosion related problems found in conventional mufflers. By thermally isolating the mixing chamber 262 from the inner and outer chambers 226 and 242, heat generated by the hot engine combustion product 13 is restricted to the mixing chamber 262 and is not passed through the chambers 226 and 242 containing the speakers 222, 228, 253, and 254.

Although the invention has been described in detail with reference to certain preferred embodiments, variations and modifications exist within the scope and spirit of the invention as described and defined in the following claims.

We claim:

1. An exhaust processor assembly comprising a housing formed to include an interior chamber and outlet means for emitting sound waves generated in the interior chamber, means for providing an acoustical mixing chamber in acoustical communication with the outlet means, means for conducting combustion product from an engine to the acoustical mixing chamber without passing through the interior chamber of the housing, means for producing sound was to attenuate noise generated by combustion product introduced into the acoustical mixing chamber through the conducting means, and means for mounting the producing means in the interior chamber to partition the interior chamber, the mounting means and producing means cooperating to define a first sub-chamber having an opening communicating with the outlet means and a second sub-chamber providing a chamber in spaced-apart relation from the outlet means.

2. The assembly of claim 1, wherein the providing means includes a pipe section that is formed to include the acoustical mixing chamber therein and means for connecting the outlet means to the pipe section to communicate sound waves from the interior chamber to the acoustical mixing chamber without transferring heat by conduction from the pipe section to the outlet means, and the connecting means is made of a thermally insulative material.

3. The assembly of claim 2, wherein the pipe section is a metal tube and the outlet means includes a metal pipe and the connecting means includes an insulative ring interconnecting the metal tube and pipe and holding the metal tube and pipe in spaced-apart relation to minimize conductive heat transfer therebetween.

4. The assembly of claim 2, wherein the pipe section is a tail pipe.

5. The assembly of claim 1, wherein the producing means includes at least one speaker located in the interior chamber.

6. The assembly of claim 1, wherein the producing means includes a bracket coupled to the interior chamber of the housing to partition the interior chamber into first and second sub-chambers and the first sub-chamber communicates with the acoustical mixing chamber through the outlet means.

7. The assembly of claim 6, wherein the producing means further includes a speaker mounted to the bracket to face toward the outlet means.

8. The assembly of claim 6, wherein the bracket is generally V-shaped and formed to include a first and second opening and the producing means further includes a first and second speaker mounted to the bracket to fit in the first and second openings, respectively, to face toward the outlet means.

9. The assembly of claim 1, wherein the housing is formed to include an outlet aperture opening into the interior chamber, the outlet means includes a first tube section coupled to the housing at the outlet aperture thereof to cause sound waves emitted from the interior chamber to travel into a passageway formed in the first tube section through the outlet aperture of the housing and the providing means includes a second tube section providing the acoustical mixing chamber, and the introducing means empties combustion product from the engine into the acoustical mixing chamber formed in the second tube section.

10. The assembly of claim 9, wherein the providing means further includes means for connecting the first tube section to the second tube section to communicate sound waves from the interior chamber to the acoustical mixing chamber without transferring heat by conduction from the first tube section to the second tube section and the connecting means is made of a thermally insulative material.

11. The assembly of claim 10, wherein the first and second tube sections are made of metal and the connecting means includes an insulative ring interconnecting the first and second tube sections and holding the first and second tube sections in spaced-apart relation to minimize conductive heat transfer therebetween.

12. The assembly of claim 9, wherein the second tube section is formed to include a side opening and the conducting means includes an exhaust pipe extending through the side opening and having an open mouth lying in the passageway formed in the second tube section.

13. The assembly of claim 12, wherein the second tube section is curved and the exhaust pipe is straight, the exhaust processor is positioned to extend the straight exhaust pipe through the side opening formed in the curved second tube section and to situate the open mouth of the exhaust pipe in the passageway formed in the second tube section.

14. The assembly of claim 6, wherein a thermally isolating coupler connects the mixing chamber to the outlet means.

15. An exhaust processor assembly for eliminating at least a portion of the noise associated with combustion product from an engine traveling through a conduit, the exhaust processor assembly comprising a housing formed to include a longitudinally extending interior chamber having a length and width and an outlet means for emitting sound waves generated in the interior region, a bracket positioned in the interior chamber to extend transversely across the width of the interior chamber to define a first sub-chamber having an opening communicating with the outlet means and a second sub-chamber, means for providing a acoustical mixing chamber in acoustical communication with the outlet means, means for acoustically coupling the acoustical mixing chamber and the conduit, to conduct combustion product through the conduit without passing through the interior chamber of the housing and a speaker mounted to the bracket so as to be positioned in the second sub-chamber, the speaker cooperating with the bracket to partition the interior into said first and second sub-chambers including means for producing sound waves to attenuate noise generated by combustion product introduced into the acoustical mixing chamber through the coupling means.

16. An exhaust processor assembly for eliminating at least a portion of the noise associated with combustion product from an engine traveling through a conduit, the exhaust processor assembly comprising a housing formed to include an interior chamber and an outlet means for emitting sound waves generated in the interior region, a generally V-shaped bracket formed to include a first and second opening, the bracket being positioned in the interior chamber to define a first sub-chamber communicating with the outlet means and a second sub-chamber, means for providing a acoustical mixing chamber in acoustical communication with the outlet means, means for acoustically coupling the acoustical mixing chamber and the conduit, and a first speaker and a second speaker mounted to the bracket to fit in the first and second openings, respectively, and arranged to face toward the open sub-chamber.

17. An exhaust processor assembly comprising an outer housing formed to include a first interior chamber and first outlet means for emitting sound waves generated in the first interior chamber, an inner housing formed to include a second interior chamber and second outlet means for emitting sound waves generated in the second interior chamber, the inner housing being situated in the first interior chamber to position the second outlet means for the inner housing in the first outlet means of the outer housing, means for providing an acoustical mixing chamber in acoustical communication with the first and second outlet means, means for introducing combustion product from an engine into the acoustical mixing chamber, and means for producing sound waves to attenuate noise generated by combustion product introduced into the acoustical mixing chamber through the introducing means, the producing means being situated in at least one of the first and second interior chambers.

18. The assembly of claim 17, wherein the producing means includes at least one speaker positioned in the first interior chamber to produce cancelling sound waves in the first interior chamber so that said cancelling sound waves will migrate into the acoustical mixing chamber through the first outlet means to combine with and attenuate sound of combustion product extant in the acoustical mixing chamber.

19. The assembly of claim 18, wherein the outer housing is formed to include an outlet aperture opening into the first interior chamber, the first outlet means includes a tube having a proximal end coupled to the outer housing at the outlet aperture to cause sound waves emitted from the first interior chamber to travel into a passageway formed in the tube through the outlet aperture and a distal end providing a tail pipe means, and the introducing means extends into the passageway in the tube and to discharge combustion product from the engine into the passageway to locate the acoustical mixing chamber in the passageway of the tube.

20. The assembly of claim 18, wherein the producing means includes a single speaker in the first interior chamber.

21. The assembly of claim 20, wherein the speaker includes a frame and a sound radiating member coupled to the frame and the frame is mounted in the first interior region to aim the sound radiating member in a direction facing the first outlet means.

22. The assembly of claim 18, wherein the producing means includes a pair of speakers in the first interior chamber.

23. The assembly of claim 22, wherein each speaker includes a frame and a sound radiating member coupled to the frame and the frames are mounted in the first interior region to arrange the sound radiating members in confronting relation to one another.

24. The assembly of claim 22, wherein each speaker includes a frame and a sound radiating member coupled to the frame and the frames are mounted in the first interior region at an angle to one other to arrange the sound radiating member at an angle to one another.

25. The assembly of claim 17, wherein the producing means further includes at least one speaker positioned in the second interior chamber to produce cancelling sound waves in the second interior chamber so that said cancelling sound waves will migrate into the acoustical mixing chamber through the second outlet means to combine with and attenuate sound of combustion product extant in the acoustical mixing chamber.

26. The assembly of claim 25, further comprising a tail pipe coupled to the first outlet means and wherein the inner housing is formed to include an outlet aperture opening into the second interior chamber, the second outlet means includes a tube having a proximal end coupled to the inner housing at the outlet aperture to cause sound waves emitted from the second interior chamber to travel into a passageway formed in the tube through the outlet aperture and a distal end extending into the tail pipe, and the introducing means extends through the tail pipe and into the passageway formed in the tube to discharge combustion product from the engine into the passageway to locate the acoustical mixing chamber in the passageway in the tube and the tail pipe containing the tube.

27. The assembly of claim 25, further comprising a tail pipe coupled to the first outlet means and wherein the tail pipe is formed to include a first side opening, the second outlet means includes an inner tube coupled to the inner housing and emptying into the tail pipe, the inner tube is formed to include a second side opening adjacent to the first side opening formed in the tail pipe, and the introducing means includes an exhaust tube extending through the first and second side openings and having an open mouth lying in a passageway formed in the inner tube.

28. The assembly of claim 25, wherein the producing means includes a single speaker in the second interior chamber.

29. The assembly of claim 25, wherein the producing means includes a pair of speakers in the second interior chamber.

30. The assembly of claim 17, wherein the producing means includes at least one first speaker in the first interior chamber provided by the outer housing and at least one second speaker in the second interior chamber provided by the inner housing.

31. The assembly of claim 30, wherein the producing means includes a first pair of opposing speakers in the first interior chamber and a second pair of opposing speakers in the second interior chamber.

32. The assembly of claim 30, wherein the producing means includes a first pair of speakers situated in the first interior chamber and arranged at right angles to one another and a second pair of speakers situated in the second interior chamber and arranged at an angle to one another.

33. The assembly of claim 17, wherein a thermally isolating coupler connects the mixing chamber to the first and second outlet means.

34. An exhaust processor assembly comprising means for providing an acoustical mixing chamber, an outer housing formed to include a first interior chamber and first outlet means for emitting sound waves generated in the first interior chamber into the acoustical mixing chamber, an inner housing formed to include a second interior chamber and second outlet means for emitting sound waves generated in the second interior chamber into the acoustical mixing chamber, the inner housing being situated to lie in the first interior chamber of the outer housing, means for introducing combustion product from an engine into the acoustical mixing chamber, first producing means for producing cancelling sound waves in the first interior chamber of the outer housing so that said cancelling sound waves will migrate into the acoustical mixing chamber through the first outlet means to combine with and attenuate sound of combustion product in the acoustical mixing chamber, and second producing means for producing cancelling sound in the second interior chamber of the inner housing so that said cancelling sound waves will migrate into the acoustical mixing chamber through the second outlet means to combine with and attenuate sound of combustion product in the acoustical mixing chamber.

35. The assembly of claim 34, wherein the first producing means includes at least one low-frequency speaker and means for operating the at least one low-frequency speaker to produce low-frequency sound waves.

36. The assembly of claim 34, wherein the first producing means includes two low-frequency speakers mounted in the first interior chamber to face toward one another and means for operating the two low-frequency speakers to produce low-frequency sound waves.

37. The assembly of claim 36, wherein the outer housing includes partition means for dividing the first interior chamber into a first sub-chamber in acoustical communication with the acoustical mixing chamber and a second sub-chamber, and a first of the low-frequency speakers is situated in the first sub-chamber and a second of the low-frequency speakers is situated in the second sub-chamber.

38. The assembly of claim 37, wherein the first low-frequency speaker is mounted to the partition means to face toward the second sub-chamber and the second low-frequency speaker is mounted to the partition means to face toward the first sub-chamber.

39. The assembly of claim 36, wherein the outer housing includes partition means for dividing the first interior chamber into first a sub-chamber in acoustical communication with the acoustical mixing chamber and a second sub-chamber, the partition means is generally V-shaped and formed to include a first and second opening, and a first and second low-frequency speaker are mounted to the partition means to fit in the first and second openings, respectively, to face toward the first outlet means.

40. The assembly of claim 34, wherein the second producing means includes at least one high-frequency speaker and means for operating the at least one high-frequency speaker to produce high-frequency sound waves.

41. The assembly of claim 34, wherein the second producing means includes two high-frequency speakers mounted in the second interior chamber and means for operating the two high-frequency speakers to produce high-frequency sound waves.

42. The assembly of claim 41, wherein the inner housing includes partition means for dividing the second interior chamber into a third sub-chamber in acoustical communication with the acoustical mixing chamber and a fourth sub-chamber, and a first of the high-frequency speakers is situated in the third sub-chamber and a second of the high-frequency speakers is situated in the fourth sub-chamber.

43. The assembly of claim 42, wherein the first high-frequency speaker is mounted to the partition means to face toward the fourth sub-chamber and the second high-frequency speaker is mounted to the partition means to face toward the third sub-chamber.

44. The assembly of claim 42, wherein the partition means is generally V-shaped and formed to include a first and second opening, and the first high-frequency speaker and the second high-frequency speaker are mounted to the partition means to fit in the first and second openings, respectively, to face toward the second outlet means.

45. The assembly of claim 34, wherein the outer housing includes a top half shell and a bottom half shell attached to the top half shell to define the first interior chamber of the outer housing and the first producing means includes at least one speaker in the first interior chamber of the outer housing.

46. The assembly of claim 45, wherein the outer housing further includes partition means for dividing the first interior chamber into a first sub-chamber situated to communicate with the acoustical mixing chamber through the first outlet means and a second sub-chamber and the first producing means is coupled to the partition means.

47. The assembly of claim 46, wherein the first producing means includes a first speaker mounted on the partition means and positioned to lie in the first sub-chamber and a second speaker mounted on the partition means and positioned to lie in the second sub-chamber.

48. The assembly of claim 34, wherein the inner housing includes a top half shell and a bottom half shell attached to the top half shell to define the second interior chamber of the inner housing and the second producing means includes at least one speaker in the second interior chamber of the inner housing.

49. The assembly of claim 48, wherein the inner housing further includes partition means for dividing the second interior chamber into a first sub-chamber situated to communicate with the acoustical mixing chamber through the second outlet means and a second sub-chamber and the second producing means is coupled to the partition means.

50. The assembly of claim 49, wherein the second producing means includes a first speaker mounted on the partition and positioned to lie in the first sub-chamber and a second speaker mounted on the partition and positioned to lie in the second sub-chamber.

51. The assembly of claim 34, wherein a thermally isolating coupler connects the mixing chamber to the first and second outlet means.

52. An exhaust processor assembly comprising an outer housing formed to include a first interior chamber and first outlet means for emitting sound waves generated in the first interior chamber, an inner housing formed to include a second interior chamber and second outlet means for emitting sound waves generated in the second interior chamber, the inner housing being situated in the first interior chamber to position the second outlet means of the inner housing in the first outlet means of the outer housing, means for providing an acoustical mixing chamber in acoustical communication with the first and second outlet means, means for introducing combustion product from an engine into the acoustical mixing chamber, a first mounting bracket positioned in the first interior chamber, a first speaker mounted to the first bracket, the first speaker and first bracket cooperating to position the first interior chamber to define a first sub-chamber having an opening communicating with the first outlet means and a second sub-chamber, a second mounting bracket positioned in the second interior chamber, and second speaker mounted to the second bracket, the second speaker and second bracket cooperating to partition the second interior chamber to define a third sub-chamber having an opening communicating with the second outlet means and a fourth sub-chamber.

53. The assembly of claim 52, wherein the first mounting bracket is fixed to the outer housing and extends across the first interior chamber of the outer housing, the first speaker includes a frame assembly, a first diaphragm, and means for moving the first diaphragm to produce cancelling sound waves in the first interior chamber, and the frame assembly of the first speaker is fixed to the first mounting bracket to position an outwardly opening side of the first diaphragm in an orientation aiming toward the first sub-chamber.

54. The assembly of claim 52, wherein the second mounting bracket is fixed to the inner housing and extends across the second interior chamber of the inner housing, the second speaker includes a frame assembly, a second diaphragm, and means for moving the second interior chamber, and the frame assembly of the second speaker is fixed to the second mounting bracket to position an outwardly opening side of the second diaphragm in an orientation aiming toward the third sub-chamber.

55. The assembly of claim 52, wherein a thermally isolating coupler connects the mixing chamber to the first and second outlet means.

56. An exhaust processor assembly comprising an outer housing formed to include a first interior chamber and first outlet means for emitting sound waves generated in the first interior chamber, a first mounting bracket positioned in the first interior chamber of the outer housing to define therein a first sub-chamber having an opening communicating with the first outlet means and a second sub-chamber, an inner housing formed to include a second interior chamber and second outlet means for emitting sound waves generated in the second interior chamber, the inner housing being situated in the first sub-chamber to position the second outlet means of the inner housing in the first outlet means of the outer housing, a second mounting bracket positioned in the second interior chamber of the inner housing to define therein a third sub-chamber having an opening communicating with the second outlet means and a fourth sub-chamber, means for providing an acoustical mixing chamber in acoustical communication with the first and second outlet means, means for introducing combustion product from an engine into the acoustical mixing chamber, and means for producing cancelling sound waves including a first speaker mounted in the first sub-chamber, a second speaker mounted in the second sub-chamber, a third speaker mounted in the third sub-chamber, and a fourth speaker mounted in the fourth sub-chamber, the first and second speakers being mounted to the first mounting bracket to face toward one another, and the third and fourth speakers being mounted to the second bracket to face toward one another.

57. An exhaust processor assembly comprising an outer housing formed to include a first interior chamber and first outlet means for emitting sound waves generated in the first interior chamber, a generally V-shaped first mounting bracket formed to include a first and second aperture, the first mounting bracket being positioned in the first interior chamber of the outer housing to define therein a first sub-chamber communicating with the first outlet means and a second sub-chamber, an inner housing formed to include a second interior chamber and second outlet means for emitting sound waves generated in the second interior chamber, the inner housing being situated in the first sub-chamber to position the second outlet means of the inner housing in the first outlet means of the outer housing, a generally V-shaped second mounting bracket formed to include a third and fourth aperture, the second mounting bracket being positioned in the second interior chamber of the inner housing to define therein a third sub-chamber communicating with the second outlet means and a fourth sub-chamber, means for providing an acoustical mixing chamber in acoustical communication with the first and second outlet means, means for introducing combustion product from an engine into the acoustical mixing chamber, and first means for producing cancelling sound waves in the first interior chamber, the means including a first speaker and a second speaker mounted to fit in the first and second apertures of the first mounting bracket, respectively, the first and second speakers being positioned in the second sub-chamber so that said cancelling sound waves will migrate into the acoustical mixing chamber through the first outlet means, and second means for producing cancelling sound means in the second interior chamber, the second means including a third speaker and a fourth speaker mounted to fit in the third and the fourth apertures of the second mounting bracket, respectively, the third and fourth speakers being positioned in the fourth sub-chamber so that said cancelling sound waves will migrate into the acoustical mixing chamber through the second outlet means.

58. The assembly of claim 57, wherein the first and second speakers are low-frequency speakers.

59. The assembly of claim 57, wherein the third and fourth speakers are high-frequency speakers.

60. An exhaust processor assembly comprising a housing formed to include an interior chamber and outlet means for emitting sound waves generated in the interior chamber, a tail pipe having a first end connected to the outlet means, a second end formed to include a discharge outlet, and a side wall lying between the first and second ends and defining means for transmitting sound waves emitted through the outlet means to the discharge outlet, the side wall being formed to include an aperture, means for conducting combustion production from an engine into the transmitting means, the conducting means including a pipe section passing through the aperture and having a combustion product outlet dispensing combustion product into the tail pipe, the combustion product outlet of the pipe section and the discharge outlet of the tail pipe being situated in spaced-apart relation to define an acoustical mixing chamber therebetween in the transmitting means of the tail pipe, and means for producing sound waves to attenuate noise generated by combustion product introduced into the acoustical mixing chamber through the transmitting means, the producing means being located in the interior chamber of the housing.

61. The assembly of claim 60, wherein the pipe section includes a curved portion in the transmitting means.

62. The assembly of claim 61, wherein the tail pipe is a straight pipe.

63. The assembly of claim 60, wherein the pipe section includes a straight portion in the transmitting means.

64. The assembly of claim 63, wherein the tail pipe is a curved pipe.

* * * * *